US008366332B2

(12) United States Patent
Oi et al.

(10) Patent No.: US 8,366,332 B2
(45) Date of Patent: Feb. 5, 2013

(54) METHOD OF SETTING PAPER IN A PRINTER, AND A PRINTER

(75) Inventors: Tomoyuki Oi, Matsumoto (JP); Hiroyuki Motoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 552 days.

(21) Appl. No.: 12/398,964

(22) Filed: Mar. 5, 2009

(65) Prior Publication Data

US 2009/0224020 A1 Sep. 10, 2009

(30) Foreign Application Priority Data

Mar. 6, 2008 (JP) ..... 2008-055889

(51) Int. Cl.
*B41J 11/44* (2006.01)

(52) U.S. Cl. ..... 400/76

(58) Field of Classification Search ..... 400/76, 400/74, 103, 642, 707.1, 708
See application file for complete search history.

(56) References Cited

U.S. PATENT DOCUMENTS

| | | | | |
|---|---|---|---|---|
| 5,480,244 | A * | 1/1996 | Senda | 400/582 |
| 6,609,844 | B1 * | 8/2003 | Petteruti et al. | 400/88 |
| 6,752,548 | B2 * | 6/2004 | Azami | 400/76 |
| 7,072,596 | B2 * | 7/2006 | Smith et al. | 399/45 |
| 7,986,420 | B2 * | 7/2011 | Harris | 358/1.14 |
| 2007/0121144 | A1 * | 5/2007 | Kato | 358/1.14 |

FOREIGN PATENT DOCUMENTS

| | | |
|---|---|---|
| JP | 2005-007761 A | 1/2005 |
| JP | 2007-137524 A | 6/2007 |

* cited by examiner

*Primary Examiner* — Seung Lee
(74) *Attorney, Agent, or Firm* — Kilpatric Townsend & Stockton LLP

(57) ABSTRACT

When the paper loaded in a printer is changed to a different type of paper, the paper setting in the printer can be easily updated without a paper mismatch error occurring. When the paper is replaced or the paper setting is changed in the printer 1, the cover 3 is first opened, the roll paper 12 is removed from the roll paper compartment 11, and the cover 3 is then closed. A paper settings update command from the host device 32 is received and executed when no roll paper is loaded. After the command is executed, the cover 3 is opened, new roll paper 12 is loaded, and the cover 3 is closed. The printer 1 then indexes the newly loaded paper for printing, and executes a paper identification process to determine if the newly loaded paper matches the content of the current paper settings.

16 Claims, 7 Drawing Sheets

| STATE / OPERATION | (STATE 1) ready idle | (STATE 2) parameters not set no paper idle | (STATE 3) parameters set no paper idle | (STATE 4) parameters not set mismatch error | (STATE 5) parameters set mismatch error |
|---|---|---|---|---|---|
| EXECUTE PAPER SETTINGS UPDATE COMMAND | TO STATE 5 | TO STATE 3 | TO STATE 3 (RESET) | x COMMAND NOT EXECUTABLE | x COMMAND NOT EXECUTABLE |
| REMOVE PAPER, CLOSE COVER | TO STATE 2 | x COMMAND NOT EXECUTABLE | x COMMAND NOT EXECUTABLE | TO STATE 2 | TO STATE 5 |
| LOAD PAPER, CLOSE COVER | TO STATE 4 | TO STATE 4 | TO STATE 1 (PRINTING ENABLED) | TO STATE 4 | TO STATE 1 (PRINTING ENABLED) |

FIG. 7

METHOD OF SETTING PAPER IN A PRINTER, AND A PRINTER

CROSS-REFERENCES TO RELATED APPLICATIONS

This application claims priority to Japanese Patent Application No. 2008-055889, filed Mar. 6, 2008, the entire disclosure of which is expressly incorporated by reference herein.

BACKGROUND OF THE INVENTION

1. Field of Invention

The present invention relates generally to a printer and more particularly to a method of setting paper in a printer that executes a paper identification operation after the paper (recording paper) is replaced to determine if the paper that is loaded matches the paper information (including type and size) set in the printer.

2. Description of Related Art

Printers that convey and print to roll paper, which is composed of a continuous web of plain paper, label paper, paper with index markings, or other type of medium wound into a roll, and can print to paper that differs in the type or size of paper or label, for example, are known from the literature. Paper information such as the paper type and size is set in the printer, and the printer prints based on this paper information.

When the roll paper is replaced, the printer advances (indexes) the paper so that the start printing position at the leading end part of the paper is desirably positioned to the printing position of the print head, and executes a paper identification process while the paper is conveyed to determine, for example, the type and size of the paper. If the paper loaded in the printer does not match the paper information set in the printer, the operating mode of the printer is changed to the error mode and print commands, for example, from the upstream host computer (external device) are not accepted so that the printer does not operate inappropriately. It is therefore necessary to reset the paper information set in the printer whenever a different type of paper is loaded. The paper information is typically changed by using the operating panel of the printer to switch the operating mode of the printer to the update mode and then enter the correct information.

Japanese Unexamined Patent Appl. Pub. JP-A-2005-7761 teaches a printing device (printer) that simplifies changing the paper information when the paper is changed to a different type of paper. This printer switches to an error mode when the paper that is loaded does not match the stored paper information, but if the user opens and closes the access cover for opening and closing the opening to the roll paper compartment after this error state is entered, the printer switches to an operating mode for automatically detecting the type or size, for example, of the paper that was loaded and updating the paper information accordingly.

However, with such a known printer executes a paper identification process to determine if the paper that was loaded matches the paper information that is stored, the paper information cannot be updated (or set) by sending commands from the host computer to which the printer is connected.

More specifically, if the paper information in the printer is updated by sending a command from the host computer, the paper that is loaded in the printer may not match the paper information after being updated by the command, and the printer may therefore not operate correctly. As a result, when the paper information is updated, the printer runs the paper identification process to determine if the paper and the paper information match.

Another error occurs when paper information is updated by sending a command from the host computer before the paper is replaced. In such a case, the updated paper information will not match the paper that is currently loaded in the printer, and a printer error occurs.

If the paper information is updated from the host computer after the paper is replaced but the paper is actually replaced before the information is updated, opening and closing the access cover causes the printer to automatically execute the paper identification process based on the currently set paper information, a printer error occurs, and the paper information cannot later be updated from the host.

It is conceivable to update the paper information from the host side before the roll paper is loaded when replacing the paper (that is, at the point the access cover is opened and the roll paper is removed from the roll paper compartment). However, because there is no paper in the printer before the roll paper is loaded in the known printer, the printer returns a no-paper error or goes off-line because there is no paper and refuses commands sent from the host side, and the paper information therefore cannot be updated.

It is therefore necessary to update the paper information by using the operating panel on the printer, or by providing exceptional functionality such as the ability to switch the printer to an automatic paper information updating mode when a paper mismatch error occurs and the access cover is opened and closed as described in Japanese Unexamined Patent Appl. Pub. JP-A-2005-7761.

SUMMARY OF THE INVENTION

A printer and a paper setting method for a printer according to the embodiments of the present invention enable setting or updating paper information by means of a command sent from the host device side without generating a paper mismatch error when replacing the paper with paper of different specifications.

A first aspect of the invention is a paper setting method for a printer that executes a paper identification process of conveying the paper and detecting if the paper matches the stored paper settings when the paper that is loaded in the printer is replaced or the paper information that is set in the printer is updated (which includes setting the information). When the printer detects an error state (including a no-paper state), the printer enters (including keeps) a command reception state enabling receiving a command for updating (including setting) the paper information from an external device, and executes the command and updates the paper information when the command is received. When the printer detects a paper-loaded state after the paper information is updated, the printer acquires the corresponding paper information by conveying the paper, and executes a paper identification process to determine if the loaded paper matches the paper information that was set or updated.

As described above, when the paper is removed from the printer and the printer goes to a no-paper state, the printer is held to a state enabling receiving a paper information update command from the external device (a host computer) and can change the paper information in the printer by receiving the update command and executing the update command. Special intervention by the user, such as operating the operating panel of the printer, is therefore not needed to reset the paper settings when replacing the paper. In addition, because the paper information stored in the printer can be updated after first setting the printer to a no-paper state and the new paper can then be simply loaded, a mismatch between the paper information set in the printer and the paper that is actually loaded (a paper mismatch error) will not occur. Setting or updating the paper setting in the printer when loading a different type of paper can therefore be done simply and easily.

The command reception state in which the paper information update command can be received is an on-line state or printer ready state. This enables the external device to determine if the update command can be sent by detecting if the printer is in the on-line or ready state.

The printer may determine that the paper was removed and there is no paper loaded if it is detected that there is no paper in the paper storage compartment or on the transportation path through which paper is conveyed from the paper storage compartment after it is detected that the access cover for opening and closing the paper storage compartment of the printer has changed from an open state to the closed state.

In addition, the printer may determine that the paper was loaded and the paper is loaded if it is detected that paper is in the paper storage compartment or on the transportation path through which paper is conveyed from the paper storage compartment after it is detected that the access cover for opening and closing the paper storage compartment of the printer has changed from an open state to the closed state.

Because the access cover for opening and closing the paper storage compartment must always be opened and closed in order to remove paper from the printer and load new paper, whether the paper was removed and new paper was loaded can be reliably determined by detecting if the access cover closed and then detecting if paper is loaded in the printer.

A no-paper state can be determined when the paper has been removed from the paper storage compartment, and a paper-loaded state can be determined when the paper is loaded in the paper storage compartment.

Preferably, the paper is roll paper wound in a roll, and the paper storage compartment is a roll paper compartment. The embodiments of the invention can thus be used in a printer that uses roll paper, which is a continuous web of paper wound in a roll.

Another aspect of the invention is a printer that has a detector for detecting paper, a communication unit for holding the state enabling update command reception, and a control unit for executing the update command and paper identification process, and implements the paper setting method described above.

A printer according to another aspect of the invention has a transportation unit for conveying paper, a paper detector for detecting the paper, a communication unit for communicating with an external device and receiving a paper information command that is sent from the external device, a storage unit for storing the paper information, and a control unit that executes the command received by the communication unit and sets or updates the paper information in the storage unit. The communication unit enables a command reception state when the paper detector detects an error state (including a no-paper state). The control unit sets or updates the paper information in the storage unit when the communication unit receives the command from the external device, and the control unit acquires the corresponding paper information as a result of the transportation unit conveying the paper when the paper detector detects the paper-loaded state and determines if the paper matches the paper information in the storage unit.

Preferably, the command reception state in which the communication unit can receive the command is a state in which the communication unit ignores received data other than said command.

Further preferably, the printer also has a paper storage compartment for storing the paper, an access cover for opening and closing the paper storage compartment, and an access cover detector for detecting the access cover. The paper detector detects the paper after the access cover detector detects that the access cover has changed from an open state to the closed state.

Yet further preferably, the paper is roll paper wound in a roll, and the paper storage compartment is a roll paper compartment.

When the paper is removed from the printer and the printer goes to a no-paper state, the printer is held to a state enabling receiving a paper information update command sent from the external device, and can update the paper settings stored in the printer by simply executing the update command (which also functions as a setting command). The user therefore does not need to use the operating panel of the printer when changing the paper. In addition, the paper setting of the printer can be updated after the printer is set to the no-paper state, after which the paper can be loaded, and a mismatch between the paper settings stored in the printer and the paper that is actually loaded (a paper mismatch error) will not occur. The printer settings can therefore be easily reset or updated by means of a simple process when the paper in the printer is replaced with a different type of paper.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 7 is a state transition table of printer operation when replacing the paper and when updating the paper settings.

DESCRIPTION OF PREFERRED EMBODIMENTS

A printer according to an embodiment of the present invention is described below with reference to the accompanying figures.

Figure 1:
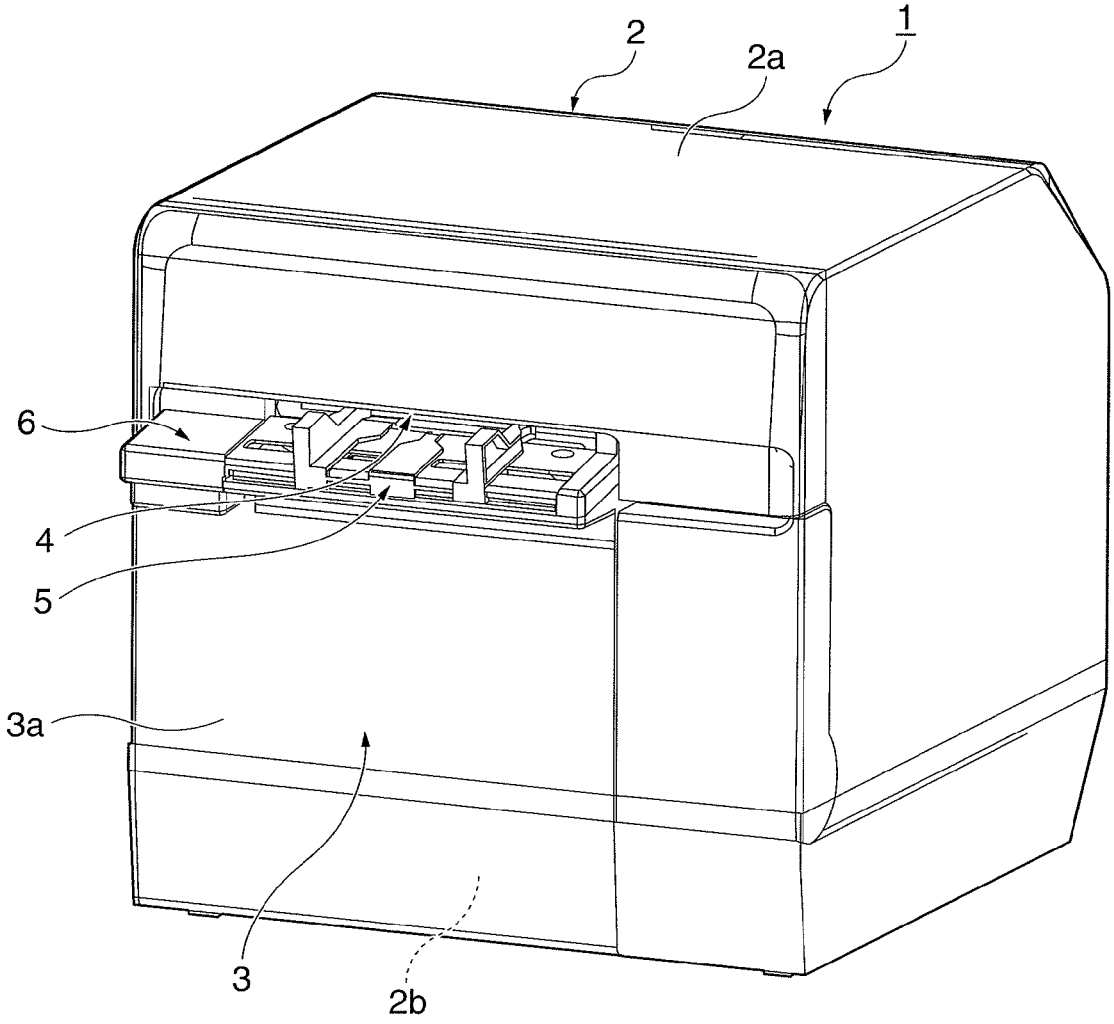
FIG. 1 is an external oblique view of a printer according to one embodiment of the invention.
Figure 2:
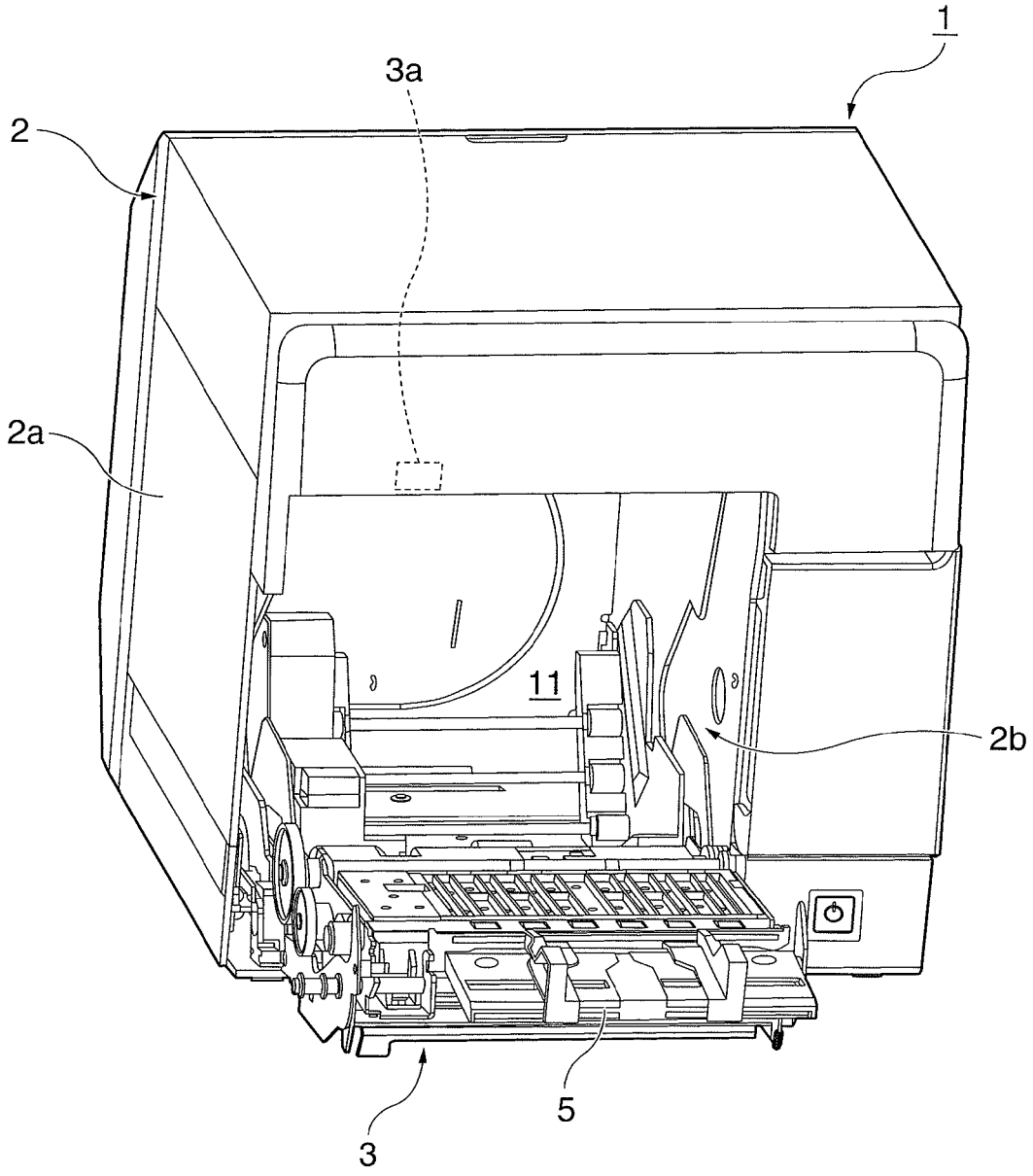
FIG. 2 is an external oblique view of the printer of FIG. 1 with the access cover open.

FIG. 1 is an oblique view showing an inkjet printer according to a first embodiment of the invention. FIG. 2 is an oblique view of the same printer with the cover completely open.

The printer 1 has a rectangular box-like case 2 and a cover 3 that opens and closes and is disposed to the front of the case 2. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3.

Operating the cover opening lever 6 unlocks the cover 3. When the exit guide 5 is pulled forward after the lock is released, the cover 3 pivots at the bottom end part thereof and opens forward to a substantially horizontal position. As shown in FIG. 2, when the cover 3 opens, the roll paper compartment 11 (roll paper loading unit) formed inside the printer opens. The transportation path A from the roll paper compartment 11 to the paper exit 4 also opens simultaneously (see FIG. 3), and the roll paper can be easily replaced from the front of the printer. Note that the cover 3 and the cover opening lever 6 are not shown in FIG. 2.

An open/close detector 3*a* is disposed near the cover 3. The open/close detector 3*a* may be a photosensor, a magnetic sensor, a microswitch, or other device. The open/close detector 3*a* detects when the cover 3 changes from an open to a closed position, or from the closed to the open position.

Figure 3:
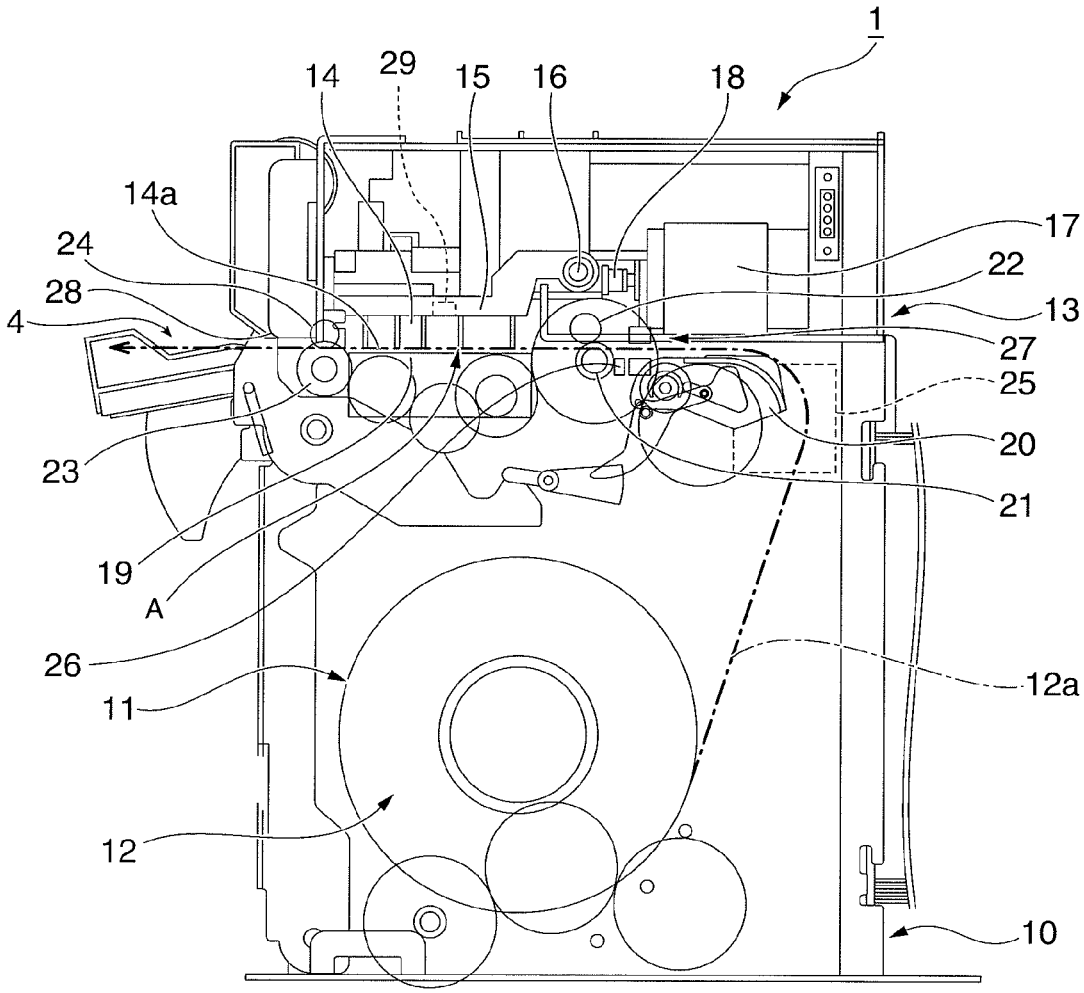
FIG. 3 is a vertical section view showing the internal structure of the printer of FIG. 1.

FIG. 3 shows the internal configuration of the printer 1. Roll paper 12 is stored inside the roll paper compartment 11 so that the roll paper 12 can roll on its side between the sides of the printer. The roll paper 12 is a continuous web of recording medium 12*a* of a constant width wound into a roll.

A head unit frame 13 is disposed horizontally at the top of the printer frame 10 above the roll paper compartment 11. Disposed in the head unit frame 13 are an inkjet head 14, a carriage 15 that carries the inkjet head 14, and a carriage guide shaft 16 that guides movement of the carriage 15 widthwise to the printer. The inkjet head 14 is mounted on the carriage 15 with the ink nozzle surface 14*a* facing down. A carriage transportation mechanism including a carriage motor 17 and timing belt 18 for conveying the carriage 15 bidirectionally along the carriage guide shaft 16 are disposed above the roll paper compartment 11.

A platen 19 extending horizontally widthwise to the printer is disposed below the inkjet head 14 with a constant gap to the ink nozzle surface 14*a*. A tension guide 20 that curves downward is attached on the back side of the platen 19.

A rear paper feed roller 21 and a rear paper pressure roller 22 are disposed horizontally widthwise to the printer behind the platen 19 (that is, on the upstream side in the transportation direction). The rear paper pressure roller 22 is pressed from above with a predetermined force to the rear paper feed roller 21 with the recording medium 12*a* therebetween. A front paper feed roller 23 and front paper pressure roller 24 are disposed on the front side of the platen 19 (downstream in the transportation direction). The front paper pressure roller 24 is pressed from above to the front paper feed roller 23 with the recording medium 12*a* therebetween. The rear paper feed roller 21 and the front paper feed roller 23 are rotationally driven synchronously by the paper transportation motor 25 disposed to the printer frame 10.

The recording medium 12*a* pulled from the roll paper 12 in the roll paper compartment 11 is set with predetermined tension applied thereto by the tension guide 20 through the transportation path A (denoted by the bold dot-dash line in FIG. 3) past the printing position of the platen 19 and out from the paper exit 4. When the paper transportation motor 25 is driven with the recording medium 12*a* thus loaded, the rear paper feed roller 21 and front paper feed roller 23 turn and the recording medium 12*a* is advanced a predetermined distance. The inkjet head 14 is also driven synchronized to conveyance of the recording medium 12*a* to print on the surface of the recording medium 12*a* as it passes the printing position. Paper transportation is then stopped with the printed portion of the recording medium 12*a* hanging out from the paper exit 4, the leading portion of the recording medium 12*a* is cut by the paper cutter 28 disposed near the paper exit 4, and the printed ticket or receipt, for example, is discharged.

Configuration of the Paper Detection Sensor

The configuration of the sensors for detecting the recording medium 12*a* on the transportation path A is described next. The printer 1 uses a reflection photosensors 26 and 29 and a transmission photosensor 27 as the paper detection sensors for detecting the recording medium 12*a*.

A reflection photosensor is disposed to the roll paper compartment 11 facing the side edge of the roll paper 12 to detect if the roll paper 12 is present.

The reflection photosensor 26 is disposed to the transportation path A on the back side of the platen 19. This reflection photosensor 26 faces the bottom side of the roll paper 12 conveyed through the transportation path A, and includes a light emitting device and a photodetector. The reflection photosensor 26 emits the detection beam from below to the detection position of the transportation path A, and detects the reflection of light to below from the recording medium 12*a* on the transportation path A to detect the reflectivity of the recording medium 12*a* passing the detection position.

The transmission photosensor 27 is disposed to the transportation path A upstream from the reflection photosensor 26. The transmission photosensor 27 is between the rear paper feed roller 21 and the tension guide 20, and includes an emitter on the top side of the transportation path A and a photodetector opposite the emitter on the bottom side of the transportation path A. The transmission photosensor 27 detects how much of the detection beam emitted to the detection position of the transportation path A from above passes the recording medium 12*a* on the transportation path A to detect the transmittance through the recording medium 12*a* at the detection position.

Figures 4A, 4B:
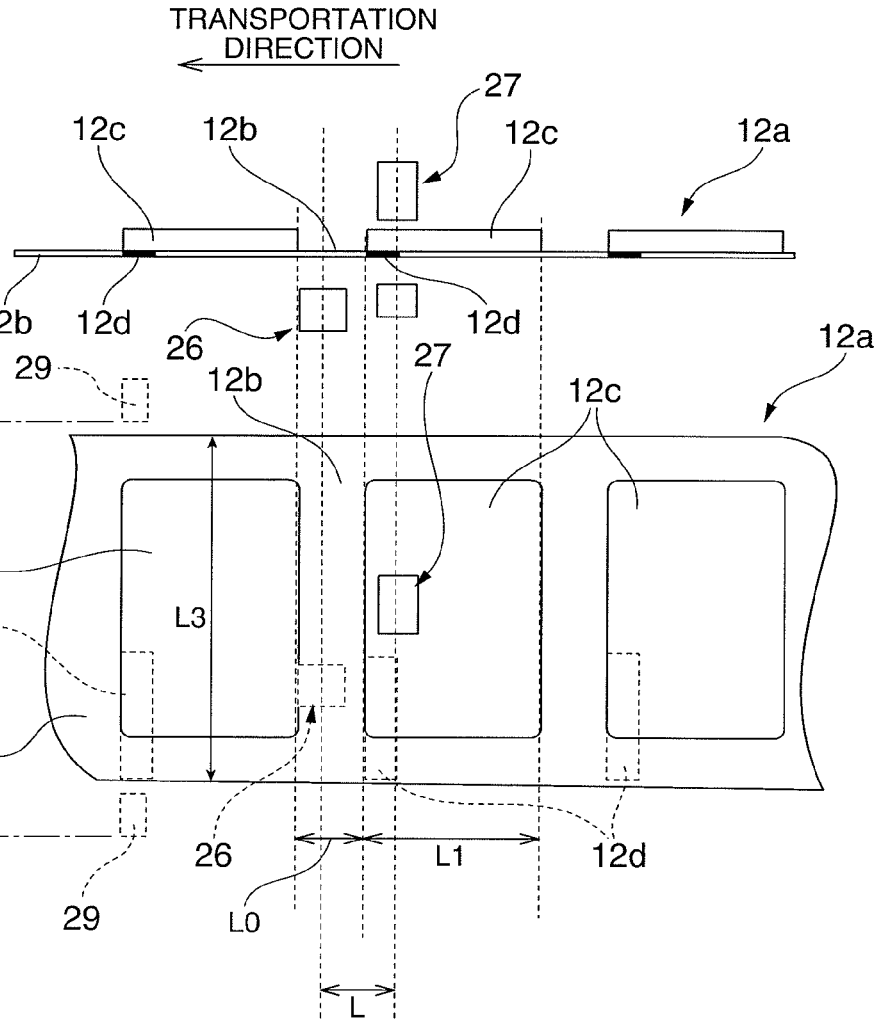
FIG. 4 is a side view and a plan view showing the positions of a reflection photosensor and a transmission photosensor.

FIG. 4A is a side view describing the positions of the recording medium 12*a*, the reflection photosensor 26, and the transmission photosensor 27 on the transportation path A, and FIG. 4B is a plan view of the same. The recording medium 12*a* shown in FIG. 4A and FIG. 4B includes a continuous liner 12*b*, peelable labels 12*c* affixed at a constant interval on the surface of the liner 12*b*, and black index marks 12*d* preprinted at a predetermined interval on the back side of the liner 12*b* to denote the position of each label 12*c*. The index marks 12*d* are printed on the back side of the liner 12*b* at positions corresponding to the downstream edge of each label 12*c* in the transportation direction.

The reflection photosensor 26 and the transmission photosensor 27 are disposed in this order from the downstream side to the upstream side in the transportation direction. The gap L in the transportation direction between the transmission photosensor 27 and reflection photosensor 26 is slightly greater than the gap L0 (the gap between labels) between the labels 12*c* on the recording medium 12*a*, and this gap is greater than or equal to the gap L0 between the labels 12*c* and less than or equal to the length of the labels 12*c* in the transportation direction. The reflection photosensor 26 and transmission photosensor 27 are disposed at positions offset along the width of the recording medium 12*a* so that each is not affected by the detection beam emitted by the other. The position of each sensor in the paper width direction is adjusted so that the reflection photosensor 26 is within the range passed by the index marks 12*d*, and the transmission photosensor 27 is within the range passed by the labels 12*c*. The emitter of the transmission photosensor 27 may be disposed on the bottom with the corresponding photodetector on the top.

The transmission photosensor 27 detects the transmittance where only the liner 12*b* is present (the gap between labels) and where both the liner 12*b* and label 12*c* are simultaneously present, and determines the position of the label 12*c* based on the difference between these transmittance values.

The reflection photosensor 26 detects the reflectance of the liner 12*b* and the label 12*c*, and based on the difference therebetween determines the position of the index mark 12*d* (the position of a label 12*c*).

The reflection photosensor 29 is disposed to the carriage 15 at the edge of the printer width (the direction perpendicular to the transportation direction). The reflection photosensor 29 is disposed facing the recording medium 12*a* on the transportation path A, and traverses the recording medium 12*a* on the transportation path A in conjunction with the bidirectional movement of the carriage 15 across the width of the recording medium 12*a*. The position where the reflection photosensor 29 is disposed is set so that the moving range L2 (see FIG. 4B) of the reflection photosensor 29 in conjunction with movement of the carriage 15 covers the passage width L3 (see FIG. 4B) of the recording medium 12*a*. The reflection photosensor 29 emits a detection beam from above to the transportation path A, and detects the reflection returned from the recording medium 12*a* on the transportation path A to detect the reflectivity of the recording medium 12*a* in the detection path of the transportation path A. The reflection photosensor 29 thus detects the width of the recording medium 12*a*.

Control System

Figure 5:
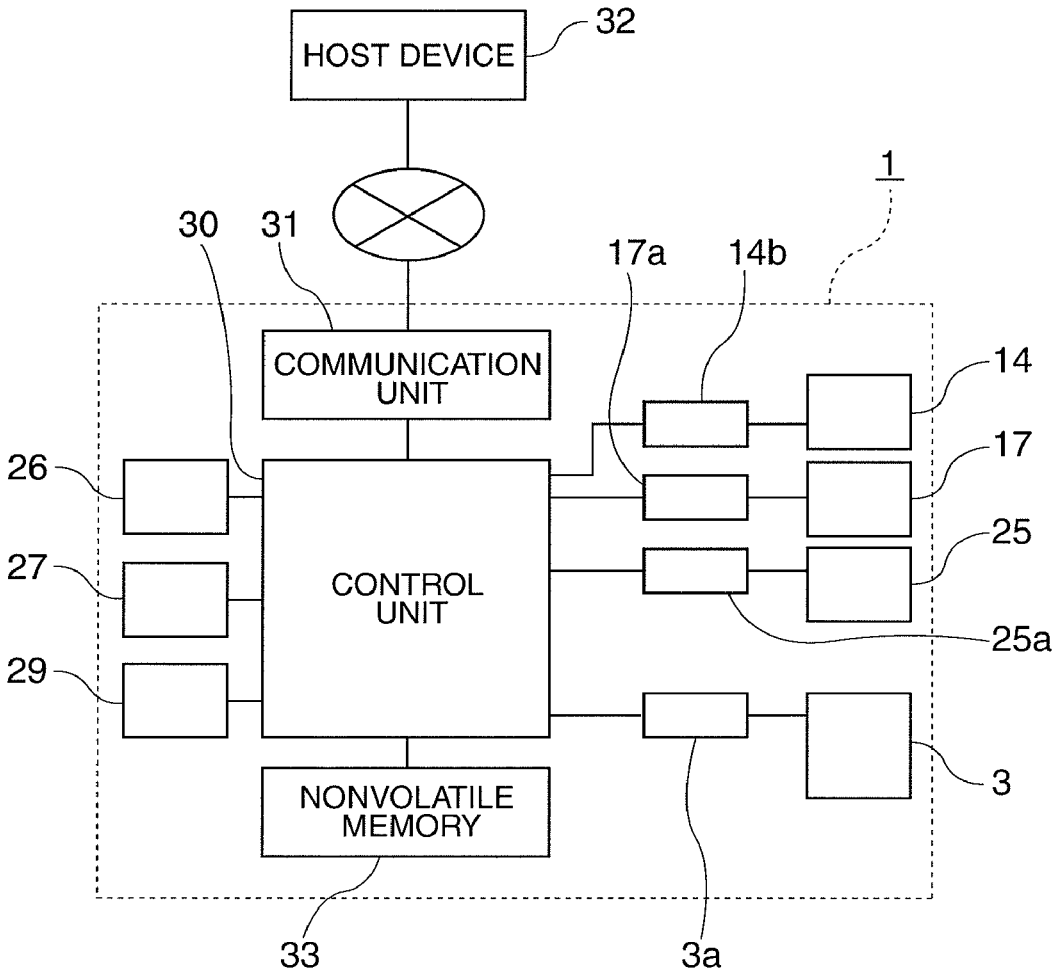
FIG. 5 is a schematic block diagram showing the control system of the printer.

FIG. 5 is a schematic block diagram showing the control system of the printer. The control system of the printer 1 is constructed around a control unit 30 including a CPU, ROM, and RAM. Nonvolatile memory 33 such as flash ROM is also connected to the control unit 30. Print data and commands are supplied from an external device such as a host device 32 through a communication unit 31 to the control unit 30. Based on print commands and other data from the host device 32, the control unit 30 controls driving the paper feed mechanism and the carriage transportation mechanism to convey the recording medium 12*a* to advance the print medium and print.

The inkjet head 14 is connected to the output side of the control unit 30 through the print head driver 14*b*, and the control unit 30 controls driving the inkjet head 14 through the print head driver 14*b*. The carriage motor 17 and paper transportation motor 25 are connected to the output side of the control unit 30 through a motor driver 17*a* and motor driver 25*a*, and the control unit 30 controls driving the paper transportation motor 25 and carriage motor 17 through the motor drivers 25*a* and 17*a*. The control unit 30 can calculate the distance the recording medium 12*a* is conveyed by integrating the number of steps or the rotational distance that the paper transportation motor 25 is driven in the advancing direction.

The open/close detector 3*a*, reflection photosensors 26 and 29, and transmission photosensor 27 are connected to the input side of the control unit 30. The detector output from each of these sensors is input to the control unit 30, which controls operation of the printer 1 based on the position of the index marks 12*d*, the position of the label 12*c*, and the width of the recording medium 12*a* determined by comparing the sensor input with predetermined threshold values.

Based on the detector output from the reflection photosensors 26 and 29 and transmission photosensor 27, the control unit 30 determines if the recording medium 12*a* is in the transportation path A and the type of recording medium 12*a*. More specifically, when the recording medium 12*a* travels through the transportation path A, the control unit 30 causes the reflection photosensor 26 and the transmission photosensor 27 to emit the detection beam at a timing specific to the transportation distance of the recording medium 12*a* to detect the reflectivity and transmittance at the detection position. This enables determining the type of material and color of the liner 12*b* and label 12*c*, and the length of the label 12*c* in the transportation direction. Whether index marks 12*d* are present and the distance between the index marks 12*d* can also be determined.

The control unit 30 measures the distance traveled by the carriage 15 by means of a linear encoder, for example, disposed to the carriage 15 as the carriage 15 moves, and causes the reflection photosensor 29 to emit the detection beam to the transportation path A at a predetermined timing to detect the reflectivity at the detection (emission) position. The widthwise edge of the liner 12*b* or label 12*c* can thus be detected, and the paper width of the liner 12*b* or label 12*c* can be determined. Whether there are any index marks 12*d* and the interval therebetween can also be determined by the reflection photosensor 29.

Control When Replacing the Paper

Control of the printer 1 when the roll paper is replaced is described next.

The printer 1 can print to various types of recording media other than the label paper shown in FIGS. 4A-B, including continuous paper with index marks that is not label paper, plain roll paper with no index marks, and other types of paper. The printer can also print to label paper and indexed paper bearing labels or index marks of different sizes, intervals, and dimensions. The printer can also print to different types of continuous roll paper other than plain paper, including glossy paper, coated papers, and different types of paper stock. The control unit 30 of the printer therefore stores paper information controlling the printing position, ink discharge amount, and other printing parameters according to the type (including parameters such as the location of the labels and index marks, paper quality, and paper width) of recording medium 12*a* that is wound into the roll paper 12 loaded in the roll paper compartment 11.

Paper information for the various types of recording medium 12*a* on which the printer 1 can print is stored in nonvolatile memory 33 in the printer 1. This paper information may be stored as default values during printer 1 manufacture, or by sending appropriate commands from the host device 32. This embodiment of the invention is described below with the paper information preset in nonvolatile memory 33 by this method.

When a paper settings update command for setting or updating the product information is input to the printer 1, the control unit 30 reads the paper information parameters to be updated contained in the paper settings update command and updates the corresponding settings in the nonvolatile memory 33 of the printer 1.

After the parameter is updated or set, printing occurs only if the recording medium 12*a* matches the paper information that is currently loaded (currently stored) in the nonvolatile memory 33. Once the paper information is set and until the next paper settings update command is received and executed, the paper parameters are stored in nonvolatile memory 33.

The control unit 30 determines if the recording medium 12*a* that is loaded matches the paper settings that are stored in the nonvolatile memory 33, and if the paper and the paper information do not match, the printer 1 returns a paper mismatch error to prevent problems caused by printing where printing is inappropriate.

The paper settings update command is input from the host device 32 to the communication unit 31 of the printer 1. The paper settings update command may also be input by an operation performed at the printer 1. The printer 1 can set the communication unit 31 to the READY state whether the roll paper 12 is loaded or is not loaded in the roll paper compartment 11 so that the paper settings update command can be received. The control unit 30 can also execute the paper settings update command whether or not the roll paper 12 is loaded in the roll paper compartment 11.

Figure 6:
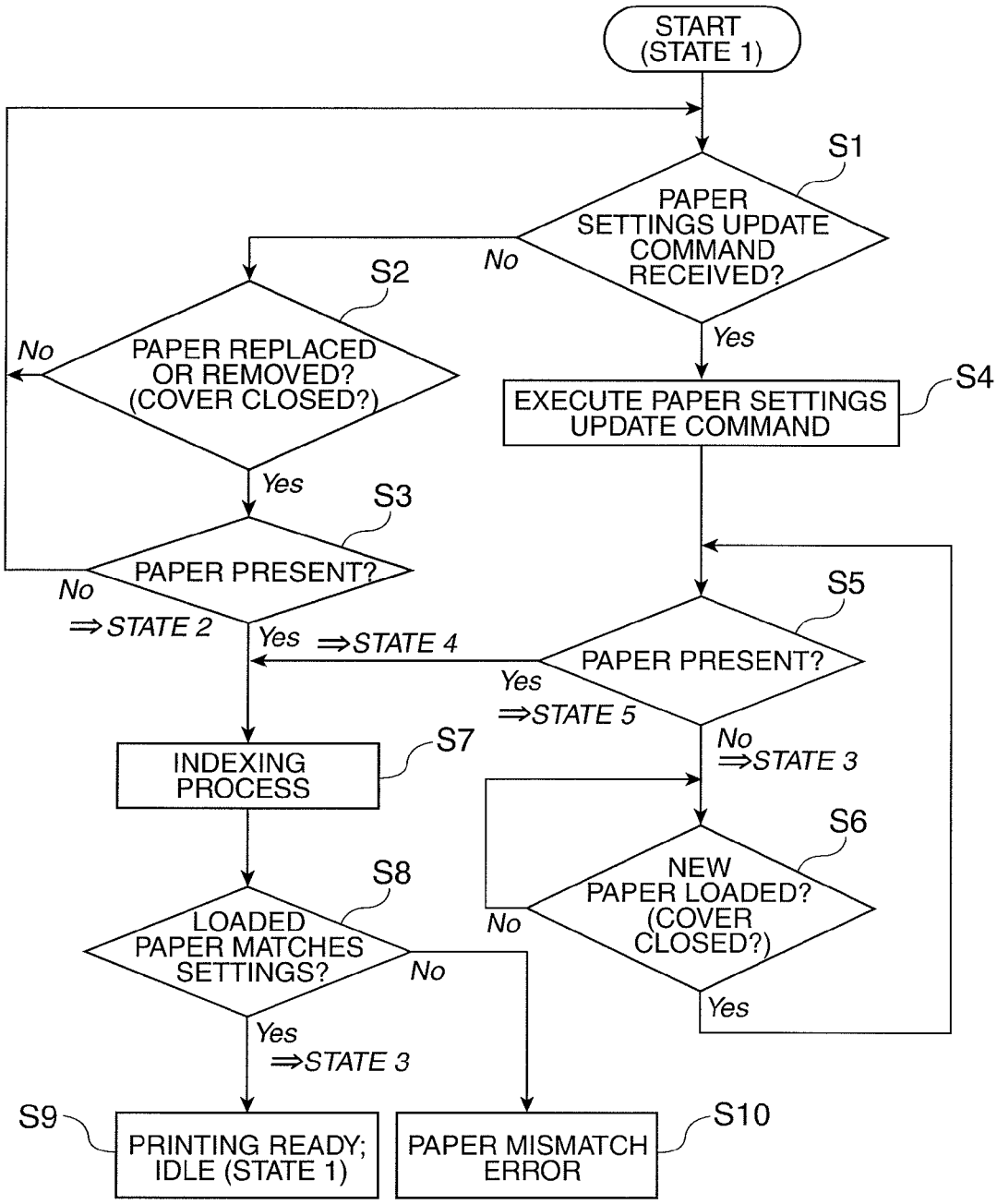
FIG. 6 is a flow chart of the control process of the printer when replacing the paper and when updating the paper settings.

FIG. 6 is a flow chart describing control of the printer 1 when the paper is replaced and the paper settings (paper information) are updated or changed. FIG. 7 is a state transition table of the printer 1 when the paper is replaced or the paper information is set or updated. The change between the five states (state 1 to state 5) in FIG. 7 is shown in relation to the three operations of executing the paper settings update command, removing paper, and loading paper.

State 1: printing enabled (signal reception enabled); idle

State 2: paper information not set; no paper; idle (the state when the roll paper 12 is removed from the roll paper compartment 11 and new paper is not loaded or the paper settings update command is not executed)

State 3: paper information set; no paper; idle (the state when the roll paper 12 is removed from the roll paper compartment 11 and new paper is not loaded but the paper settings update command was executed)

State 4: paper information not set; paper mismatch error (error returned because the paper information is not updated)

State 5: paper information set; paper mismatch error (paper information is updated but error returned)

The operation and control of the printer 1 when replacing paper and setting or updating the paper information is described next with reference to FIG. 6 and FIG. 7.

An exemplary procedure anticipated as a correct procedure for replacing the paper and updating the paper information in this embodiment of the invention is the first procedure executed in the sequence of steps 1a to 1c as described below.

First Procedure

1a: Remove the currently loaded roll paper 12 from the roll paper compartment 11, close the cover 3 without loading a different roll paper 12, and set the printer 1 to the no-paper state.

1b: Receive and execute a paper settings update command sent from the host device 32 with no paper loaded.

1c: After executing the paper settings update command, set a new roll paper 12 into the roll paper compartment 11 and close the cover 3.

The control unit 30 controls printer 1 operation as described below when the paper is replaced and the paper parameters are set according to this first procedure.

When the printer 1 is in state 1 (idle with printing enabled, that is the normal printing standby state waiting for print data from the host), the control unit 30 determines regularly or at a predetermined time if the paper settings update command was received (S1), and repeatedly determines (S2) if the cover 3 is closed based on the output from the open/close detector 3*a*. Because the roll paper 12 is removed before the paper settings update command is received in this first procedure (step 1a), step S2 detects that the cover 3 is closed (S2 returns Yes), and control goes to step S3.

Whether roll paper 12 is loaded in roll paper compartment 11 is then determined in S3. This decision is based on the output from the reflection photosensor 26 or transmission photosensor 27. In step 1a the cover 3 is closed without inserting a new roll of paper after removing the roll paper 12. The printer 1 therefore goes to state 2 shown in FIG. 7 (paper information not set, no paper, idle). Step S3 therefore determines there is no paper (S3 returns No), and control loops back to S1. When step S3 determines there is no paper (S3 returns No) in this embodiment of the invention, a busy (BUSY) or off-line (OFF-LINE) state is not entered as it is in the related art, the communication unit 31 remains set to the READY or ON-LINE state for receiving data, and commands and data from the host device 32 can be received. Steps S1 to S3 thus repeat until the paper settings update command is received. Note that when control returns to step S1, step S2 may be skipped and steps S1 and S3 may be executed without executing step S2.

Preferably, in step S1, the communication unit 31 determines if the received command is the paper settings update command, and may either ignore or drop any command other than the paper settings update command. This enables receiving and executing only the paper settings update command without being affected by receiving or executing other commands. Print data may also be similarly ignored or dropped. These operations may also be executed by the control unit 30 through the communication unit 31.

If procedure 1*b* is executed, step S1 determines that the paper settings update command was received (S1 returns Yes), and control goes to step S4. In step S4 the control unit 30 executes the received paper settings update command whether or not roll paper 12 is loaded in the roll paper compartment 11. The paper settings update command is executed as described below.

The control unit 30 overwrites and stores the configuration data contained in the received paper settings update command to the predetermined data block in the nonvolatile memory 33 where the paper information is saved. Alternatively, the paper information corresponding to a particular argument in the paper settings update command is stored to predetermined addresses in the control unit 30 memory, the control unit 30 reads the paper information corresponding to each argument from the control unit 30 memory when a paper settings update command is received, and overwrites and stores the new value to the predetermined data block in nonvolatile memory 33.

Because there is no paper in the printer 1 in this situation, executing the paper settings update command causes control to go to state 3 in FIG. 7 (settings saved, no paper, idle).

The control unit 30 then determines if roll paper 12 is loaded in the roll paper compartment 11 (S5). In S5 the control unit 30 determines if the recording medium 12*a* is loaded to the transportation path A based on the output from the reflection photosensor 26 or transmission photosensor 27. Because there is no paper in the printer 1 at procedure 1*b*, step S5 detects there is no paper (S5 returns No), and control goes to step S6.

To determine if a new roll paper 12 was loaded after the paper settings update command was executed, the control unit 30 determines in step S6 if the cover 3 was closed based on the output from the open/close detector 3*a*. Because the roll paper 12 has not been loaded when procedure 1*b* executes, the control unit 30 determines that the cover 3 is not closed (S6 returns No), and step S6 therefore repeats until the cover 3 is closed.

When procedure 1*c* executes and the control unit 30 detects in step S6 that the cover 3 is closed (step S6 returns Yes), control returns to step S5. Because procedure 1*c* has already executed, the roll paper 12 is loaded (step S5 returns Yes), and the recording medium 12*a* pulled from the loaded roll paper 12 is conveyed to the predetermined indexing position, that is, the paper is positioned to the print head (step S7). This indexing position is set a predetermined distance downstream from the reflection photosensor 26 or transmission photosensor 27. After the reflection photosensor 26 or transmission photosensor 27 detects the recording medium 12*a*, the control unit 30 conveys the recording medium 12*a* the distance to the indexing position further downstream. This indexing operation sets the position of the roll paper 12 where printing is to start (the indexing position), such as the beginning of a label 12*c*, to the position of the inkjet head 14 (printing position) while detecting the position of the label 12*c* or index mark 12*d*.

After the indexing operation is finished, the control unit 30 determines if the recording medium 12*a* of the currently loaded roll paper 12 corresponds to the paper information updated by the command executed in step S2 (step S8). The control unit 30 executes the detection process by means of the reflection photosensors 26 and 29 or transmission photosensor 27 during the indexing operation. While determining the type of recording medium 12*a* that is currently loaded based on the detection results returned during the indexing operation, step S5 determines if the currently loaded recording medium 12*a* matches the type of paper identified by the currently stored paper information. If the paper matches (step S8 returns Yes), the printer 1 returns to state 1 (the printing-enabled idle state).

If due to a user mistake, for example, roll paper 12 wound with a different type of recording medium 12*a* than the paper type indicated by the paper settings update command is loaded, state 5 (paper information set, paper mismatch error) occurs, and the recording medium 12*a* that is loaded is known to not match the current paper settings (step S8 returns No). An appropriate error handling process (step S10) then executes to handle the paper mismatch error. For example, if a paper mismatch error occurs the error is reported to the host device 32 or a predetermined error handling process is executed and control returns to step S1 to repeat the paper replacement and update the paper settings. Alternatively, step S6 may execute without returning to step S1 to simply load the paper after handling the error.

As described above, this embodiment of the invention goes through a no-paper state when replacing the roll paper 12 to enable receiving and executing a paper settings update command from the host device 32 when there is no paper loaded, and a paper mismatch error state therefore cannot occur when replacing the paper and updating the settings. More specifically, if the paper is replaced and the settings are updated in the first procedure, which is the correct operating procedure, and the type of recording medium 12*a* that is actually loaded is made to match the paper type specified by the paper settings update command, the state transition of the operating state of the printer 1 goes state 1 to state 2 to state 3 and to state 1, and the paper can be replaced and the paper information updated without a paper mismatch error state (state 5) occurring. The user therefore does not need to operate the operating panel of the printer 1 to directly enter the paper information when replacing the paper, a special mode does not need to be selected for updating the paper information, and replacing the paper and setting the paper information can be controlled simply.

Control When the Paper is Not Replaced Using the Correct Procedure

A paper mismatch error may occur due to a paper replacement error or because the paper was replaced and the paper information updated according to a procedure that differs from the correct first procedure described above. The control process executed in this situation is described below. Two examples of such incorrect procedures are described as the second procedure and third procedure below. These procedures are executed when the paper settings update command is received and executed when the roll paper 12 is loaded before or after the paper is replaced without setting the printer 1 to the no-paper state.

Second Procedure

The paper settings update command sent from the host device 32 is received and executed without removing the currently loaded roll paper 12 and with the roll paper 12 still loaded. The roll paper 12 used up until then is then removed from the roll paper compartment 11, new roll paper 12 is loaded, and the cover 3 is closed.

Third Procedure

The roll paper 12 used up until then is first removed from the roll paper compartment 11, new roll paper 12 is loaded, and the cover 3 is closed. With the new roll paper 12 loaded, the paper settings update command sent from the host device 32 is received and executed.

What happens in the case of the second procedure is described next.

As described in the second procedure, if the command is received and executed without removing the roll paper 12 that was used until then, operation proceeds from step S1 to S4 and then S5, step S5 returns Yes without step S6 determining if the cover 3 is open or closed, the paper is therefore indexed (S7), and whether the stored paper information matches the paper that is actually loaded is determined (S8). Because the paper settings are updated before the paper is changed, operation goes to state 5 (paper settings completed, paper mismatch error) and the error handling process executes (S10).

If the predetermined error handling process is configured to return to step S1 or S6 in this situation, replacing the paper and configuring the paper settings can be completed normally and control can return to state 1 (printing enabled, idle) by simply opening the cover 3 after cancelling the error, loading roll paper 12 matching the new paper settings, and then closing the cover 3. More specifically, replacing the paper and configuring the paper settings can be completed by executing the steps described above in the order state 1 to state 5 to state 3 to state 1.

What happens in the case of the third procedure is described next.

If replacing the paper is completed first as described in the third procedure above, operation goes from step S1 to S2 to S3 to S7, the indexing step S7 executes without the paper settings update command being received in step S4, and whether the paper that is loaded matches the current paper settings is determined in step S8. Because the paper settings update command has not been executed in this situation, control goes to state 4 (paper information not set, paper mismatch error) and the prescribed error handling process executes (S10).

If the predetermined error handling process is configured to return to step S1 in this situation, operation can be reset to state 2 (paper information not set, no paper, idle) by removing the roll paper 12 that was loaded to reset the printer 1 to the no-paper state, and the paper settings update command can then be executed. The paper can therefore be replaced and the paper information reset normally. More specifically, replacing the paper and configuring the paper settings can be completed by executing the steps described above in the order state 1 to state 4 to state 3 to state 1.

Other Embodiments

Detecting if the roll paper 12 was removed and if new roll paper 12 was loaded occurs in the embodiment described above when the cover 3 is detected to have changed from the open position to the closed position, and when the roll paper 12 is then detected to have been loaded. However, an optical or contact sensor for detecting if the roll paper or other recording medium is present may be disposed in the roll paper loading unit of the roll paper compartment 11, and whether roll paper or other recording medium is present may be detected directly from the output of this sensor.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A paper setting method for a printer, comprising:

detecting whether or not paper is present in a paper storage compartment of the printer;

when the paper is not present, entering a command reception state enabling receiving a command that is sent from an external device for setting or updating paper information stored in the printer;

when the command is received, executing the command to set or update the paper information and then detecting whether or not the paper is present;

when the paper is present, conveying the paper to an indexing position and determining whether the paper matches the paper information;

when the paper matches the paper information, entering a printer-enabled idle state; and when the paper does not match the paper information, entering a paper mismatch error state.

2. The method of claim 1, further comprising determining whether a paper cover is closed; and when the paper cover is closed, detecting whether or not the paper is present.

3. The method of claim 2, wherein determining whether the paper cover is closed comprises using a magnetic sensor, a photosensor, or a microswitch.

4. The method of claim 1, wherein the printer does not accept any other command from the external drive when in the command reception state.

5. The method of claim 1, wherein the printer is in an on-line state or ready state when in the command reception state.

6. The method of claim 1, wherein determining whether the paper matches the paper information comprises using a paper detector.

7. The method of claim 6, wherein the paper detector is a reflection photosensor or a transmission photosensor.

8. A printer comprising:

a transportation unit for conveying paper;

a paper storage compartment for storing the paper;

a paper detector for detecting the paper;

a communication unit for communicating with an external device and receiving a paper information command that is sent from the external device;

a storage unit for storing the paper information; and a control unit, configured for:

detecting whether or not paper is present in the paper storage compartment;

when the paper is not present, entering a command reception state enabling receiving a command that is sent from an external device for setting or updating paper information stored in the printer;

when the command is received, executing the command to set or update the paper information and then detecting whether or not the paper is present;

when the paper is present, conveying the paper to an indexing position and determining whether the paper matches the paper information;

when the paper matches the paper information, entering a printer-enabled idle state; and when the paper does not match the paper information, entering a paper mismatch error state.

9. The printer of claim 8, further comprising:

a paper cover for opening and closing the paper storage compartment; and a paper cover detector for detecting whether the paper cover is open or closed.

10. The printer of claim 9, wherein the control unit is further configured for, determining whether a paper cover is closed; and when the paper cover is closed, detecting whether or not the paper is present.

11. The printer of claim 9, wherein the paper cover detector comprises a magnetic sensor, a photosensor, or a microswitch.

12. The printer of claim 9, wherein the paper is roll paper wound in a roll; and the paper storage compartment is a roll paper compartment.

13. The printer of claim 8, wherein the communication unit does not accept any other command from the external drive when the control unit is in the command reception state.

14. The printer of claim 8, wherein the control unit is in an on-line state or ready state when in the command reception state.

15. The printer of claim 8, wherein the paper detector comprises a reflection photosensor or a transmission photosensor.

16. The printer of claim 8, wherein the paper is a plain roll paper with no index marks, a label paper, a label paper or indexed paper bearing labels or index marks of different sizes, intervals, and dimensions, or a glossy paper, or a coated paper.

* * * * *